United States Patent [19]

Rudnick

[11] 4,303,496

[45] Dec. 1, 1981

[54] COAL LIQUEFACTION PROCESS

[75] Inventor: Leslie R. Rudnick, Trenton, N.J.

[73] Assignee: Mobil Oil Corporation, New York, N.Y.

[21] Appl. No.: 178,214

[22] Filed: Aug. 14, 1980

[51] Int. Cl.[3] ..... C10G 1/00; C10G 1/06; B09B 3/00

[52] U.S. Cl. ..... 208/8 LE; 208/10; 208/8 R; 201/21

[58] Field of Search ..... 208/8 R, 8 LE, 10; 201/21

[56] References Cited

U.S. PATENT DOCUMENTS 2,591,496 4/1952 Berl ..... 201/2.5 X
4,247,384 1/1981 Chen et al. ..... 208/8 LE

FOREIGN PATENT DOCUMENTS 173907 1/1922 United Kingdom ..... 208/8 R

*Primary Examiner*—Delbert E. Gantz
*Assistant Examiner*—William G. Wright
*Attorney, Agent, or Firm*—Charles A. Huggett; Charles J. Speciale; Stanislaus Aksman

[57] ABSTRACT

The invention is directed to undertaking the liquefaction of coal in the presence of lignin.

8 Claims, 1 Drawing Figure

COAL LIQUEFACTION PROCESS

FIELD OF THE INVENTION

In the last two decades there has been a resurgence of interest in coal as a source of synthetic crude oil. Accordingly, the art relating to the liquefaction of coal has developed significantly in the last two decades. However, substantially all of the art relating to coal liquefaction relates to optimizing coal liquefaction processes from an engineering point of view. Optimization of coal liquefaction and other coal chemistry has not been approached as extensively from a chemical point of view.

SUMMARY OF THE INVENTION

The invention is directed to improving coal liquefaction processes by a chemical approach.

The invention involves the addition of lignin to coal during the solubilization stage of liquefaction.

Addition of the lignin is to accelerate coal liquefaction under the conditions of liquefaction. Use of the lignin in this way is advantageous as it is quite inexpensive and available in large quantities.

DESCRIPTION OF THE FIGURE

The FIGURE schematically represents a typical system used in coal liquefaction. In the FIGURE, coal can be admixed, optionally, with the H-donor solvent and passed to the preheater 3. From the preheater 3 the coal travels to the dissolver 4.

The lignin used in accordance with the invention can be added to the coal in the mixer 1, in the preheater 3 and/or in the dissolver 4. Preferably, however, the lignin is added to the system and to the coal no later than the preheating stage undertaken in the preheater 3.

Figure 1:
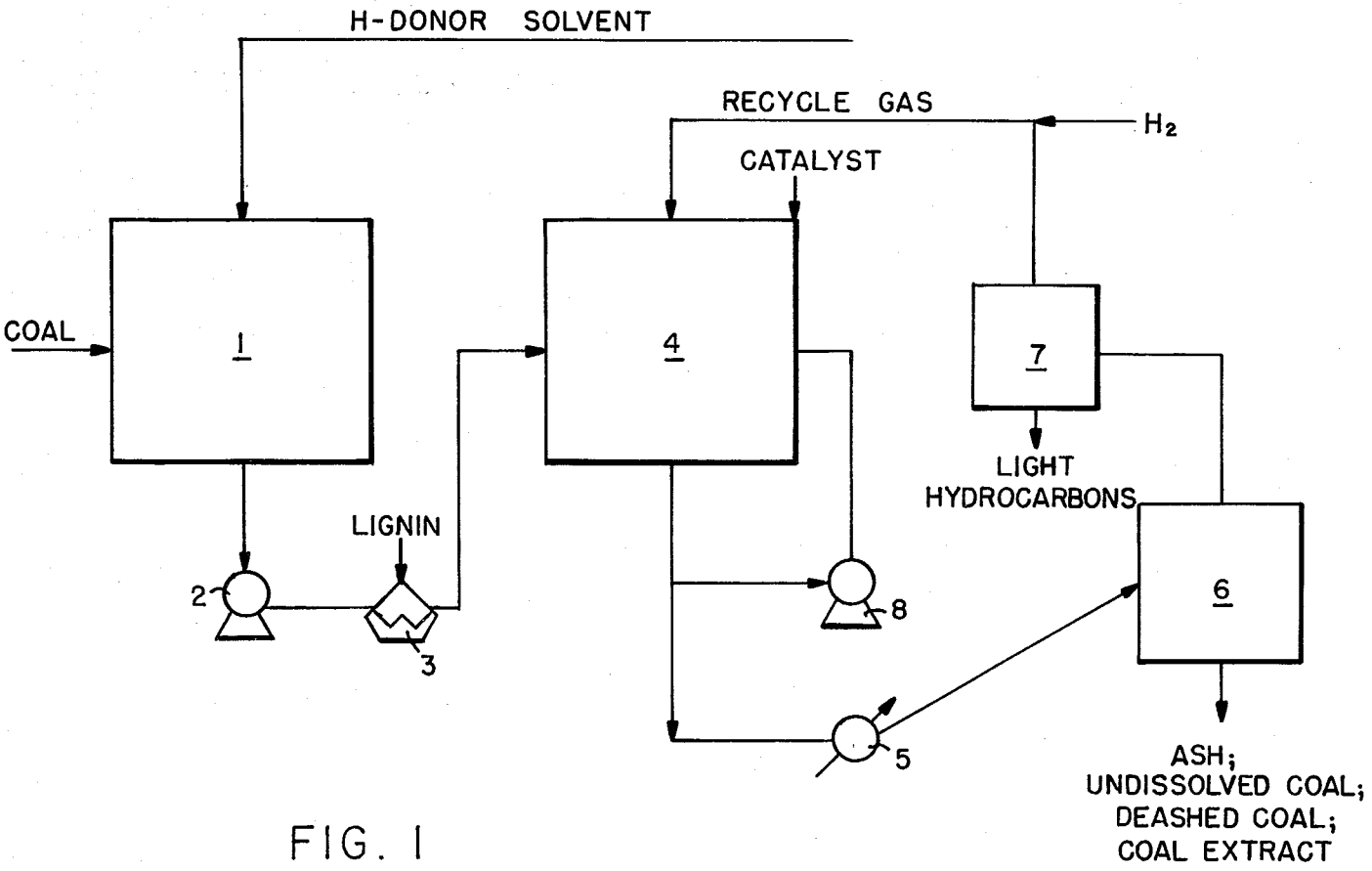

After solubilization, the treated coal travels to separator 6, optionally through a cooler 5. In separator 6, the light hydrocarbons produced during liquefaction distill out and are trapped in drop-out pot 7. The mixture of ash; undissolved coal; deashed coal and coal extract, leaving the separator can be processed according to known techniques. For example, a part of the coal extract of the mixture which can be flashed off can be recycled to mixer 1 as the H-donor solvent.

The dissolver 4 may be a part of a gas loop, receiving recycle gases from drop-out pot 7, and/or providing a means by which make-up hydrogen can be introduced into the dissolver 4. In addition, the dissolver may be part of the recycle loop through which catalyst may be added.

DETAILED DESCRIPTION OF THE INVENTION

The type of coal which is introduced into the mixer 1 is not critical. Preferably, the coal is bituminous or sub-bituminous coal.

The use of a H-donor solvent is optional. The term H-donor solvent, as it relates to liquefaction of coal, typically refers to phenanthrene, dihydrophenanthrene, tetralins, hydropyrenes or mixtures thereof. Each of these H-donor solvents is, itself, a product of coal liquefaction. Each is contained in the coal extract separated from ash, deashed coal and undissolved coal, which are separated in separator 6. Accordingly, the coal extract can be the H-donor solvent. In accordance with the invention at least a portion of coal extract leaving separator 6 can be recycled, as H-donor solvent, to mixer 1.

The weight ratio of H-donor solvent, when used, to coal can range from about 0.5 to 5.

The lignin which is used in accordance with the invention may be added at any point in the system up to and including the dissolver 4 but is preferably added to the coal no later than the preheating stage in preheater 3. The lignin is used in an amount, ranging from about 0.01 to about 1%, based on the weight of the coal. Lignin is the second most abundant polymeric organic product occurring in nature. The building blocks of lignin are coniferyl alcohol and synapyl alcohol which contain one and two or the substituted methoxy groups, respectively, on the phenolic (aryl ether) ring, as disclosed by H. Nimz, *Angew. Chem.* Inter. Ed. Vol. 13/No. 5 (1974). Accordingly, lignin can be described as a source of recurring units of the phenolic moiety, and represents an inexpensive reagent to produce by decomposition a source of compounds, oligomers, or polymers containing phenolic hydroxy groups and/or a source of ethers which upon thermal treatment yield said compounds, oligomer or polymers containing said phenolic hydroxy group.

Liquefaction of coal can simply be described as involving the thermal rupturing of linkages creating the primary products of greatest interest. The decomposition of lignin in the dissolution stage is believed to accelerate the liquefaction of coal by generating free radicals, by a hydrogen-donor function and/or simply by solvation. The only known analogy to the instant invention is the use of phenols to enhance the rate of the decomposition of di-2-naphthyl ether at 450° C., reported by T. Yao and Y. Kamiya in *Bull. Chem. Soc. Japan,* 52 (29), 492 (1979). Accordingly, it is further believed that the decomposition of lignin will accelerate the thermal decomposition of ether group-containing components of coal.

The lignin decomposes during liquefaction to accelerate coal liquefaction, in other words, to result in a higher degree of coal liquefaction.

In the dissolution, or solubilization stage, the temperature in the dissolver 4 can range from about 600° to about 1000° F. The pressure in the dissolver can be from 50 to 3000 psig. Residence time in the dissolver can range from about 0.5 to about 180 minutes. The hydrogen, which is optionally but preferably used in the liquefaction stage, can vary in flow rate from 500 SCF/BBL to 5000 SCF/BBL in excess of the amount consumed. Any conventional liquefaction catalyst, for instance cobalt molybdate, may be optionally added to the dissolver, although no catalyst is used when the liquefaction is a straight thermal liquefaction undertaken with short dissolver residence times. As can be seen from above, the conditions in the dissolver 4 encompass moderate to extreme liquefaction conditions.

While the use of lignin in coal liquefaction has been described in connection with preferred embodiments, it is evident that many alternatives, modifications and variations will be apparent to those skilled in the art in light of the foregoing description. Accordingly, it is intended to embrace all such alternatives, modifications and variations, as fall within the spirit and broad scope of the appended claims.

What is claimed is:

1. A process for the liquefaction of coal comprising admixing the coal to be subjected to liquefaction with lignin wherein the amount of lignin ranges from about 0.01 to about 1% based on the weight of the coal; introducing the mixture of coal and lignin to a dissolver wherein said mixture is subjected to elevated temperature and elevated pressure for a period of time ranging from 0.5 to 180 minutes wherein said elevated temperature ranges from about 600° F. to about 1000° F. and wherein said elevated pressure ranges from about 50 to about 3000 psig; and separating light hydrocarbon fractions from a mixture of ash, undissolved coal, deashed coal and high quality coal extracts.

2. The process of claim 1, wherein said mixture is subjected to elevated temperature and elevated pressure in the presence of hydrogen.

3. The process of claim 1, wherein the mixture contains a source of phenanthrene, dihydrophenanthrene, tetralins, hydropyrenes or mixtures thereof.

4. The process of claim 1, wherein the mixture contains a high quality coal extract, obtained by recycling at least a portion of the high quality coal extracts.

5. The process of claim 1, wherein the mixture consists essentially of said coal and said lignin and is free of a liquefaction catalyst.

6. The process of claim 1, wherein a liquefaction catalyst is added to the mixture in the dissolver.

7. The process of claim 6, wherein said catalyst is cobalt molybdate.

8. The process of claim 1, wherein the light hydrocarbon fractions are recycled into the dissolver.

* * * * *